US007992907B1

(12) United States Patent
DeJesus

(10) Patent No.: US 7,992,907 B1
(45) Date of Patent: Aug. 9, 2011

(54) ANIMAL EXCREMENT COLLECTOR DEVICE

(76) Inventor: Juan E. DeJesus, Elk Grove Village, IL (US)

( * ) Notice: Subject to any disclaimer, the term of this patent is extended or adjusted under 35 U.S.C. 154(b) by 0 days.

(21) Appl. No.: 12/878,196

(22) Filed: Sep. 9, 2010

(51) Int. Cl.
*A01K 29/00* (2006.01)
*E01H 1/12* (2006.01)

(52) U.S. Cl. ..... 294/1.4; 294/19.1

(58) Field of Classification Search ..... 294/1.3, 294/1.4, 1.5, 19.1, 55, 100; 15/257.1, 257.3, 15/257.4, 257.7, 257.9; 248/95, 99, 100
See application file for complete search history.

(56) References Cited

U.S. PATENT DOCUMENTS 528,827 A * 11/1894 Thomas ..... 294/19.1
3,833,252 A * 9/1974 Redding ..... 294/100
3,841,686 A * 10/1974 Gallo et al. ..... 294/1.4
4,179,145 A 12/1979 Shinsako
4,225,174 A * 9/1980 Hennessy et al. ..... 294/1.4
5,154,465 A * 10/1992 Pakosh ..... 294/19.1
5,380,054 A 1/1995 Galvis
5,503,442 A 4/1996 Lee
5,570,919 A * 11/1996 Eusebe ..... 294/19.1
5,601,321 A 2/1997 Simon
5,895,082 A * 4/1999 Kaluzny ..... 294/1.4
6,983,966 B2 1/2006 Azrikam
7,448,659 B1 * 11/2008 Auseklis ..... 294/1.4
2008/0303295 A1 * 12/2008 Moreno Fernandez De Betono ..... 294/1.3

* cited by examiner

*Primary Examiner* — Paul T Chin
(74) *Attorney, Agent, or Firm* — Crossley Patent Law; Mark A. Crossley

(57) ABSTRACT

An animal excrement collector device including a handle having a first internal cavity; a spring-loaded extension assembly disposed therein, that extends an extension rod from the handle upon activation of an extension button disposed on the handle; a trigger-lock mechanism, which is continuously disposed within the first internal cavity and an extension rod second internal cavity, includes a trigger grip member that activates a trigger button which, in turn, extends first and second cables that extend claw members hingedly attached to the second cables, which, in turn, expand a waste collection bag attached thereto. The claw members retract to pick up an object, such as animal excrement, and scoop the object into the waste collection bag for containment. The used waste collection bag may be hung from a J-hook disposed on a handle lower end. A bag dispenser disposed within the second internal cavity holds unused bags.

15 Claims, 4 Drawing Sheets

ANIMAL EXCREMENT COLLECTOR DEVICE

BACKGROUND OF THE INVENTION

Various types of animal waste collection and disposal devices are known in the prior art. However, what is needed is a device that includes a handle having a first internal cavity; a spring-loaded extension assembly disposed therein, that extends an extension rod from the handle upon activation of an extension button disposed on the handle; a trigger-lock mechanism, which is continuously disposed within the first internal cavity and an extension rod second internal cavity, includes a trigger grip member that activates a trigger button which, in turn, extends first and second cables that extend claw members hingedly attached to the second cables, which, in turn, expand a waste collection bag attached thereto. The claw members retract to pick up an object, such as animal excrement, and scoop the object into the waste collection bag for containment. The used waste collection bag may be hung from a J-hook disposed on a handle lower end. A torus member inserted into a hole on the handle upper end permits a user to place his wrist therethrough to securely hold onto the device. A bag dispenser disposed within the second internal cavity holds unused bags.

FIELD OF THE INVENTION

The present invention relates to a device for animal waste collection and disposal.

SUMMARY OF THE INVENTION

The general purpose of the present animal excrement collector device, described subsequently in greater detail, is to provide an animal excrement collector device which has many novel features that result in an animal excrement collector device which is not anticipated, rendered obvious, suggested, or even implied by prior art, either alone or in combination thereof.

To accomplish this, the present animal excrement collector device is used in conjunction with a waste collection bag to pick up animal excrement. The device includes a handle having a first internal cavity; a spring-loaded extension assembly disposed therein, that extends an extension rod from the handle upon activation of an extension button disposed on the handle; a trigger-lock mechanism, which is continuously disposed within the first internal cavity and an extension rod second internal cavity, includes a trigger grip member that activates a trigger button which, in turn, extends first and second cables that extend claw members hingedly attached to the second cables, which, in turn, expand a waste collection bag attached thereto. The claw members retract to pick up an object, such as animal excrement, and scoop the object into the waste collection bag for containment. The used waste collection bag may be hung from a J-hook disposed on a handle lower end. A torus member inserted into a hole on the handle upper end permits a user to place his wrist therethrough to securely hold onto the device. A bag dispenser disposed within the second internal cavity holds unused bags.

Thus has been broadly outlined the more important features of the present animal excrement collector device and method so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
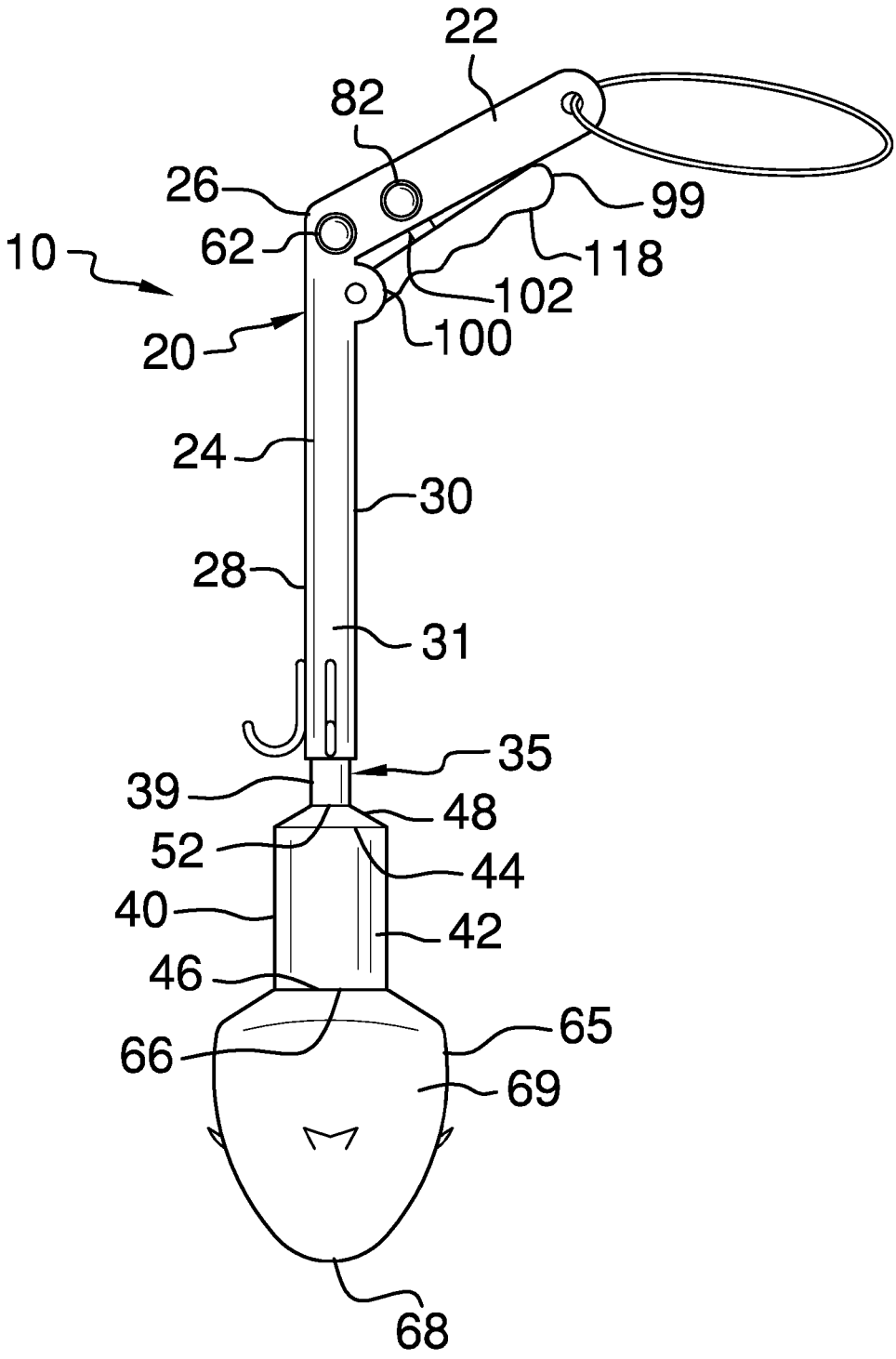
FIG. 1 is a side elevation view in a retracted position.
Figure 2:
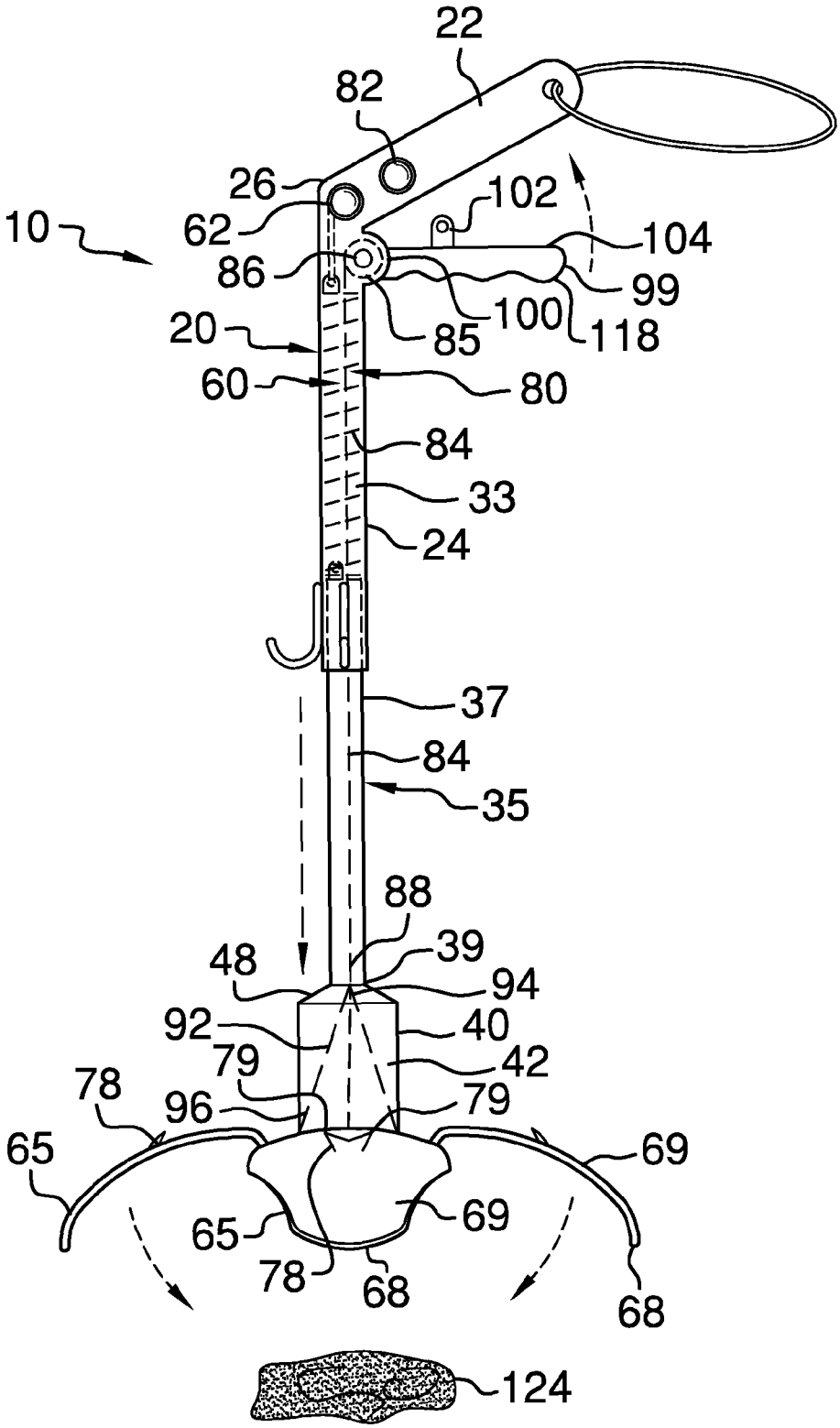
FIG. 2 is a side elevation view in an extended position.
Figure 3:
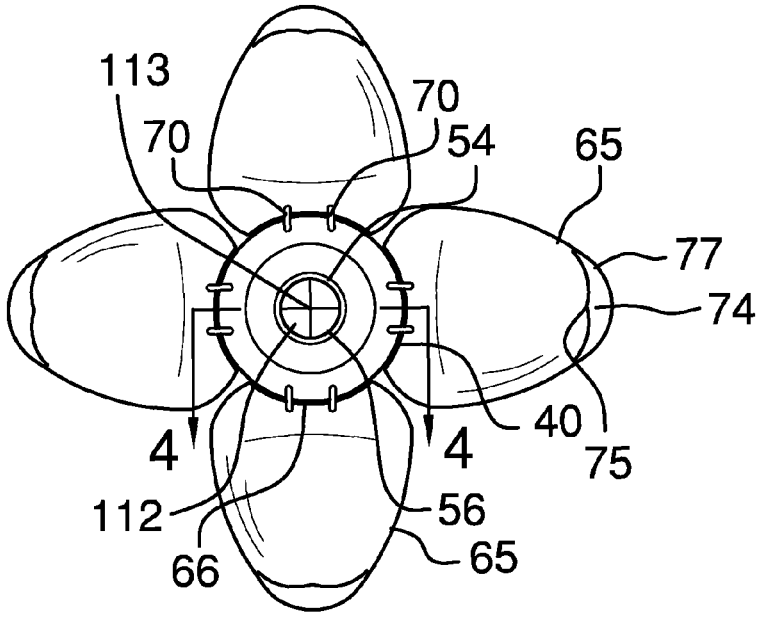
FIG. 3 is a bottom plan view.

With reference now to the drawings, and in particular FIGS. 1 through 5 thereof, example of the instant animal excrement collector device employing the principles and concepts of the present animal excrement collector device and generally designated by the reference number 10 will be described.

Referring to FIGS. 1 through 5 a preferred embodiment of the present animal excrement collector device 10 is illustrated. The animal excrement collector device 10 employs several waste collection bags 130 stored therein, which are removed therefrom and placed upon retractable claw members 65 of the device 10, to pick up animal excrement.

The animal excrement collector device 10 includes a cylindrical substantially L-shaped handle 20. The handle 20 has an upper end 22, an opposite lower end 24, a juncture 26 disposed between the upper end 22 and the lower end 24. The handle 20 also has a front side 28, a rear side 30, a right side 31, and a first internal cavity 33.

A hollow cylindrical extension rod 35 is slidingly disposed within the handle 20 first internal cavity 33. The extension rod 35 has a top end 37 and a bottom end 39. Attached to the extension rod 35 is a hollow containment body 40. The containment body 40 has a cylindrical lower portion 42 having a proximal end 44 and a distal end 46, a frusto-conical upper portion 48 attached to the proximal end 44, and a second internal cavity 50. The upper portion 48 has an upper edge 52 attached to the bottom end 39 of the extension rod 35.

A hollow bag dispenser 54 is centrally disposed within the containment body 40. The bag dispenser 54 has an aperture 56 centrally disposed within a lower wall 58 of the bag dispenser 54. A plurality of identical flexible flaps 112 is disposed within the aperture 56. The flaps 112 are releasably conjoined at a center point 113 of the aperture 56. The flaps 112 releasably engage a forward edge 132 of one of the waste collection bags 130 in order to remove the waste collection bags 130 one at a time from the bag dispenser 54.

A spring-loaded extension assembly 60 continuously disposed within the first internal cavity 33. The extension assembly 60 alternately extends and retracts the extension rod 35 outwardly from and inwardly into the handle 20 lower end 24, respectively, upon the alternate activation and deactivation, respectively, of an extension button 62 disposed on the handle 20 juncture 26. The extension button releasably lockingly engages the extension rod 35.

The present device 10 also includes a plurality of petal-shaped claw members 65. Each claw member 65 has an internal edge 66, an opposite external edge 68, and an outer wall 69. The internal edge 66 is hingedly attached to a pair of spring hinges 70, which are also attached to a bottom wall 72 of the containment body 40. Each claw member 65 has a convex longitudinal cross-section. A substantially lune-shaped ridge 74 is disposed on the external edge 68 on an underside 76 of the claw member, the ridge 74 extended inwardly from the external edge 68 of the claw member 65.

The ridge 74 has an inwardly pointed apex 75 centrally disposed on an exterior edge 77 thereof. Both the lune-shape of the ridge 74 and the inwardly pointed apex 75 provide a more secure grip onto one of the waste collection bags 130 than if the ridge 74 was straight-edged and lacked an apex 75. The ridge 74 is formed of rubber to grip the waste collection bag 130 inwardly upon retraction of the claw members 65 more easily than a slick-surface ridge which would not grip the waste collection bag 130 as well. In addition, a double-edged prong 78 is centrally disposed on the outer wall of 69 each of the claw members 65. A pair of forward edges 79 thereon is directed upwardly toward the containment body 40. The prongs 78 secure an outward edge 132 one of the waste collection bags 130 onto the claw members 65.

A trigger-lock mechanism 80 is continuously disposed in the first internal cavity 33 and the second internal cavity 50. The trigger-lock mechanism 80 alternately extends and retracts each of the spring hinges 70 and, in turn, extends and retracts the claw member 65 attached to the each spring hinge 70 whereby the claw members 65 are placed into an extended position and alternately a retracted position.

The trigger-lock mechanism 80 also includes a trigger button 82 disposed on the handle 20 upper end 22 and a spring-loaded first cable 84 having a top portion 85 continuously disposed from a spring 86, which is disposed within the first internal cavity 33 proximal to the trigger button 82, and terminating within the second internal cavity 50 proximal to the upper edge 52 of the containment body 40 upper portion 48. The first cable 84 also has a bottom portion 88. A sliding mechanism 90 slidingly engages the bottom portion 88. A plurality of second cables 92 is included in the trigger-lock mechanism 80. Each second cable 92 has an upward end 94 attached to the sliding mechanism 90 and a bottomward end 96 attached to one of the spring hinges 70. A roller 97 is disposed between each of the second cables 92 and the bag dispenser 54, wherein each second cable 92 slidingly engages an outside edge 98 of one of the rollers 98.

The trigger-lock mechanism 80 further includes an elongated spring-loaded trigger grip member 99 having an interior end 100 rotatingly attached to the spring 86 and a protrusion 102 extending outwardly from an upper wall 104 thereof. The trigger grip member 99 has an ergonomic lower edge 118 having a plurality of rounded protuberances 120 thereon and a depression 122 disposed between each of the protuberances 120. Each of the depressions 122 is sized to removably receive a finger therein in order to ensure a firm, yet comfortable, grip on the trigger grip member 99.

In use, upon the alternate releasably locking engagement and disengagement of the trigger grip member 99 with the trigger button 82, the spring 86 extends and retracts the first cable 84 downwardly and upwardly, respectively. Upon the alternate extension and retraction of the first cable 84 downwardly and upwardly, respectively, the sliding mechanism 90 alternately extends and retracts each of the second cables 92 downwardly and upwardly, respectively over an outside edge 98 of one of the rollers 97. Upon the alternate extension and retraction of the second cables 92, the spring hinges 70 extend outwardly and retract inwardly, respectively. Upon the alternate outward extension and inward retraction of each of the spring hinges 70, each of the claw members 65 alternately extend and retract, respectively.

Figure 4:
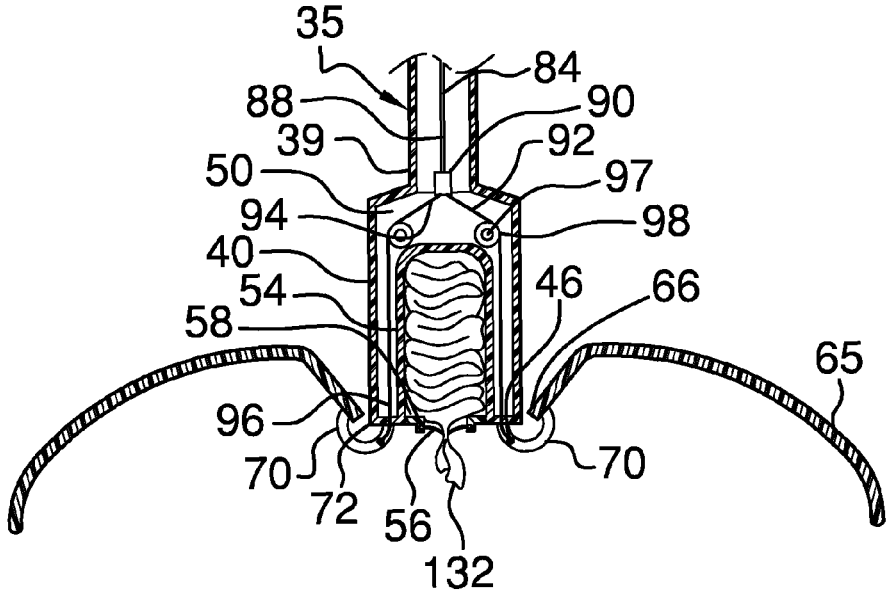
FIG. 4 is a cross-section view taken along line 4-4 of FIG. 3.
Figure 5:
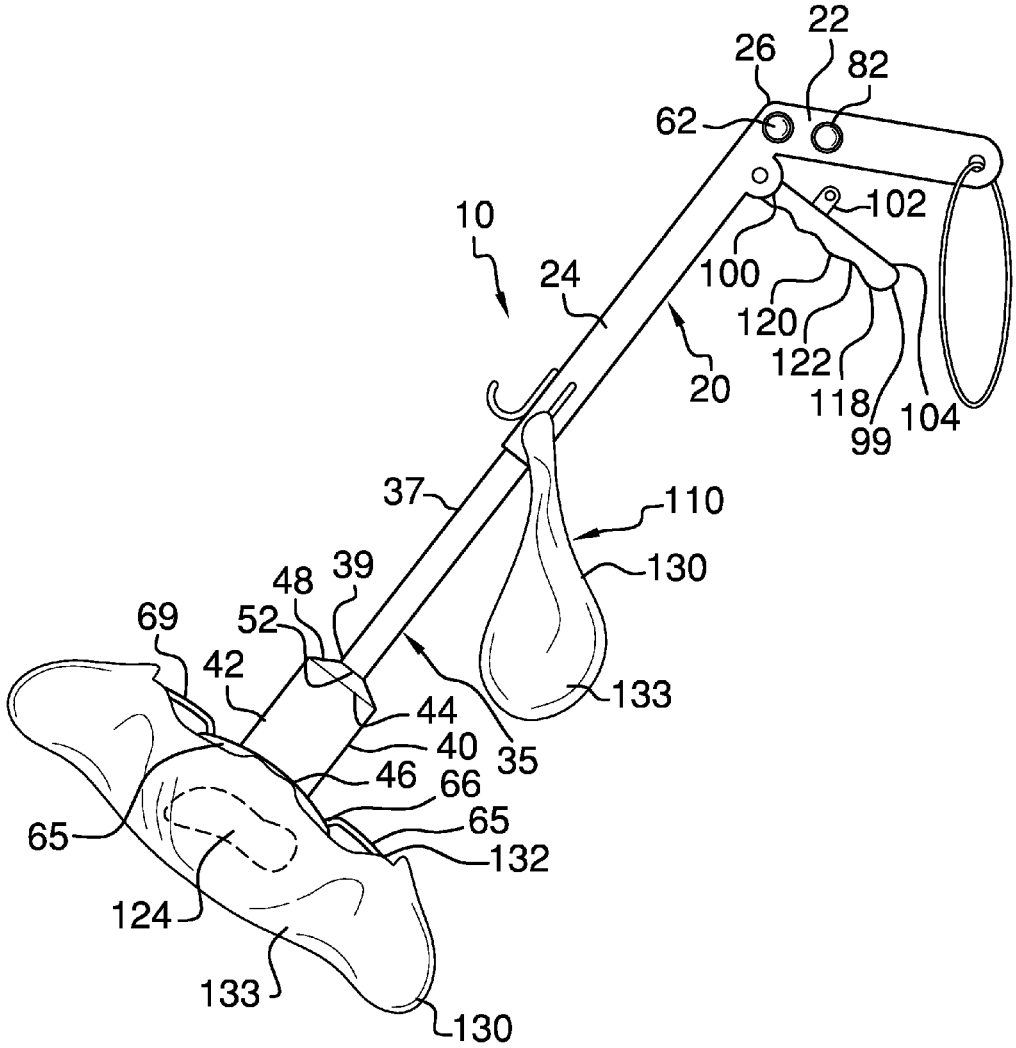
FIG. 5 is an in-use side view.

The bag dispenser 54 releasably contains at least one waste collection bag 130 therein, as shown in FIG. 4. A waste collection bag 130 contained within the bag dispenser 54 is in a contained position, while a waste collection bag 130 disposed outside the bag dispenser 54 is in a released position.

Upon the extension of the claw members 65 to the extended position, an outward edge 132 of the waste collection bag 130 in a released position removably attaches to the prongs 78 and a continuous wall 133 thereof extends over the external edge 68 of each of the claw members 65 whereby the waste collection bag 130 is in an expanded position. Upon the retraction of the claw members 65 having the continuous wall 133 of the waste collection bag 130 extended thereover, the waste collection bag 130 is in a collapsed position. Upon the retraction of the claw members 65 from an extended position into a retracted position, the waste collection bag 130 collapses from an expanded position into a collapsed position whereby an object 124, which may be an amount of animal excrement, is selectively seized by the claw members 65 and is contained within the waste collection bag 130 whereby the waste collection bag 130 is disposed in a holding position.

A cylindrical J-shaped first hook 106 is disposed on the handle 20 front side 28 proximal to the lower end 24 of the handle 20. A cylindrical J-shaped second hook 108 is disposed on the handle 20 right side 31 proximal to the lower end 24 of the handle 20. Each of the first hook 106 and the second hook 108 removably retain an item 110 thereon. The item 110 is a waste collection bag 130 in a holding position or, alternately, a small bag of dog food, a user's keys, or another similar thing which the user wishes to hang from the device 10.

A hole 114 is disposed through the handle 20 upper end 22. A torus member 116 slidingly engages the hole 20. The torus member 116 is sized to removably receive a wrist therethrough thereby allowing a user to securely hold onto the device 10 while using the device 10.

What is claimed is:

1. An animal excrement collector device comprising:

a cylindrical substantially L-shaped handle having an upper end, an opposite lower end, a juncture disposed between the upper end and the lower end, a front side, a rear side, a right side, a left side, and a first internal cavity;

a hollow cylindrical extension rod slidingly disposed within the handle internal cavity, the extension rod having a top end and a bottom end;

a hollow containment body having a cylindrical lower portion having a proximal end and a distal end, a frustoconical upper portion attached to the proximal end, and a second internal cavity, the upper portion having an upper edge, the upper portion upper edge attached to the bottom end of the extension rod;

a hollow bag dispenser centrally disposed within the containment body, the bag dispenser having an aperture centrally disposed within a lower wall of the bag dispenser;

a spring-loaded extension assembly continuously disposed within the first cavity, wherein the extension assembly releasably lockingly extends and alternately retracts the extension rod outwardly from and inwardly into the handle lower end, respectively, upon the alternate activation and deactivation, respectively, of an extension button disposed on the handle juncture, wherein the extension button is in operational communication with the extension assembly;

a plurality of petal shaped claw members, each claw member having an internal edge and an external edge, the internal edge hingedly attached to a pair of spring hinges, the spring hinges further attached to a bottom wall of the containment body, each claw member further having a convex longitudinal cross-section;

a ridge disposed on the external edge on an underside of the claw member, the ridge extended inwardly from the external edge of the claw member;

a double-edged prong centrally disposed on an outer wall of each of the claw members, wherein a pair of forward edges thereon is directed upwardly toward the containment body;

a trigger-lock mechanism continuously disposed in the first cavity and the second cavity, wherein activation and deactivation of the trigger-lock mechanism engages and releases the trigger-lock mechanism to and from, respectively, a trigger button disposed on the handle upper end, whereby the trigger-lock mechanism alternately extends and retracts each of the spring hinges and, in turn, extends and retracts the claw member attached to the each spring hinge whereby the claw members are placed into an extended position and alternately a retracted position;

wherein the bag dispenser releasably contains at least one waste collection bag therein;

wherein a waste collection bag contained within the bag dispenser is in a contained position;

wherein upon the extension of the claw members to the extended position, a waste collection bag removably attached to the claw members is in an expanded position;

wherein upon the retraction of the claw members into the retracted position, a waste collection bag removably attached to the claw members is in a collapsed position;

whereby upon the retraction of the claw members from an extended position into a retracted position, the waste collection bag collapses from an expanded position into a collapsed position whereby an object is selectively seized by the claw members and the object is contained within the waste collection bag whereby the waste collection bag is disposed in a holding position.

2. The animal excrement collector device of claim 1 wherein the trigger-lock mechanism comprises:

a trigger button disposed on the handle upper end;

spring-loaded first cable having a top portion continuously disposed from a spring disposed within the first internal cavity proximal to the trigger button and terminating within the second internal cavity proximal to the upper edge of the containment body upper portion and further having a bottom portion;

a sliding mechanism slidingly engaging the bottom portion;

a plurality of second cables, each second cable having an upward end attached to the sliding mechanism and a bottomward end attached to one of the spring hinges;

a roller disposed between each of the second cables and the bag dispenser, wherein each second cable slidingly engages an outside edge of one of the rollers;

an elongated spring-loaded trigger grip member having an interior end rotatingly attached to the spring and a protrusion extending outwardly from an upper wall thereof;

wherein upon the alternate engagement and disengagement of the trigger grip member with the trigger button, the spring extends and retracts the first cable downwardly and upwardly, respectively;

wherein upon the alternate extension and retraction of the first cable downwardly and upwardly, respectively, the sliding mechanism alternately extends and retracts each of the second cables downwardly and upwardly, respectively over the outside edge of one of the rollers;

wherein upon the alternate extension and retraction of the second cables, the spring hinges extend outwardly and retract inwardly, respectively;

wherein upon the alternate outward extension and inward retraction of each of the spring hinges, each of the claw members alternately extend and retract, respectively.

3. The animal excrement collector device of claim 2 further comprising:

a cylindrical J-shaped first hook disposed on the handle front side proximal to the lower end of the handle;

a cylindrical J-shaped second hook disposed on the handle right side proximal to the lower end of the handle;

wherein each of the first hook and the second hook removably retain an item thereon.

4. The animal excrement collector device of claim 3 further comprising a plurality of identical flexible flaps disposed within the aperture, the flaps releasably conjoined at a center point of the aperture;

wherein the flaps releasably engage a forward edge of one of the waste collection bags.

5. The animal excrement collector device of claim 4 wherein the ridge is formed of rubber whereby a secure grip on one of the waste collection bags pulls the waste collection bag inwardly during retraction of the claw members.

6. The animal excrement collector device of claim 5 further comprising:

a hole disposed through the handle upper end;

a torus member;

wherein the torus member slidingly engages the hole;

wherein the torus member is sized to removably receive a wrist therethrough.

7. The animal excrement collector device of claim 6 further comprising an ergonomic lower edge of the trigger grip mechanism, the ergonomic lower edge comprising:

a plurality of rounded protuberances disposed on the lower edge of the trigger grip mechanism;

a depression disposed between each of the protuberances;

wherein each of the depressions is sized to removably receive a finger therein.

8. The animal excrement collector device of claim 7 wherein the ridge disposed on the claw member underside is lune-shaped.

9. The animal excrement collector device of claim 8 wherein the object is an amount of animal excrement.

10. The animal excrement collector device of claim 9 wherein the item is a waste collection bag in a holding position.

11. An animal excrement collector device comprising:

a cylindrical substantially L-shaped handle having an upper end, an opposite lower end, a juncture disposed between the upper end and the lower end, a front side, a rear side, a right side, a left side, and a first internal cavity;

a hollow cylindrical extension rod slidingly disposed within the handle internal cavity, the extension rod having a top end and a bottom end;

a hollow containment body having a cylindrical lower portion having a proximal end and a distal end, a frustoconical upper portion attached to the proximal end, and a second internal cavity, the upper portion having an upper edge, the upper portion upper edge attached to the bottom end of the extension rod;

a hollow bag dispenser centrally disposed within the containment body, the bag dispenser having an aperture centrally disposed within a lower wall of the bag dispenser;

a plurality of identical flexible flaps disposed within the aperture, the flaps releasably conjoined at a center point of the aperture;

wherein the flaps releasably engage a forward edge of one of the waste collection bags;

a spring-loaded extension assembly continuously disposed within the first cavity, wherein the extension assembly releasably lockingly extends and alternately retracts the extension rod outwardly from and inwardly into the handle lower end, respectively, upon the alternate activation and deactivation, respectively, of an extension button disposed on the handle juncture, wherein the extension button is in operational communication with the extension assembly;

a plurality of petal shaped claw members, each claw member having an internal edge and an external edge, the internal edge hingedly attached to a pair of spring hinges, the spring hinges further attached to a bottom wall of the containment body, each claw member further having a convex longitudinal cross-section;

a substantially lune-shaped rubber ridge disposed on the external edge on an underside of the claw member, the ridge extended inwardly from the external edge of the claw member, the ridge having an inwardly pointed apex centrally disposed on an exterior edge thereof, wherein the ridge is formed of rubber whereby a secure grip on one of the waste collection bags pulls the waste collection bag inwardly during retraction of the claw members;

a double-edged prong centrally disposed on an outer wall of each of the claw members, wherein a pair of forward edges thereon is directed upwardly toward the containment body;

a trigger-lock mechanism continuously disposed in the first cavity, the second cavity, and the third cavity, wherein the trigger-lock mechanism alternately extends and retracts each of the spring hinges and, in turn, extends and retracts the claw member attached to the each spring hinge whereby the claw members are placed into an extended position and alternately a retracted position;

wherein the bag dispenser releasably contains at least one waste collection bag therein;

wherein a waste collection bag contained within the bag dispenser is in a contained position and further wherein a waste collection bag disposed outside the bag dispenser is in a released position;

wherein upon the extension of the claw members to the extended position, an upper perimeter edge of the waste collection bag in a released position removably attaches to the prongs and a continuous wall thereof extends over the external edge of each of the claw members whereby the waste collection bag is in an expanded position;

wherein upon the retraction of the claw members having the continuous wall of the waste collection bag extended thereover, the waste collection bag is in a collapsed position;

whereby upon the retraction of the claw members from an extended position into a retracted position, the waste collection bag collapses from an expanded position into a collapsed position whereby an object is selectively seized by the claw members and is contained within the waste collection bag whereby the waste collection bag is disposed in a holding position;

wherein the trigger-lock mechanism further comprises:

a trigger button disposed on the handle upper end;

spring-loaded first cable having a top portion continuously disposed from a spring disposed within the first internal cavity proximal to the trigger button and terminating within the second internal cavity proximal to the upper edge of the containment body upper portion and further having a bottom portion;

a sliding mechanism slidingly engaging the bottom portion;

a plurality of second cables, each second cable having an upward end attached to the sliding mechanism and a bottomward end attached to one of the spring hinges;

a roller disposed between each of the second cables and the bag dispenser, wherein each second cable slidingly engages an outside edge of one of the rollers;

an elongated spring-loaded trigger grip member having an interior end rotatingly attached to the spring and a protrusion extending outwardly from an upper wall thereof;

wherein upon the alternate engagement and disengagement of the trigger grip member with the trigger button, the spring extends and retracts the first cable downwardly and upwardly, respectively;

wherein upon the alternate extension and retraction of the first cable downwardly and upwardly, respectively, the sliding mechanism alternately extends and retracts each of the second cables downwardly and upwardly, respectively over the outside edge of one of the rollers;

wherein upon the alternate extension and retraction of the second cables, the spring hinges extend outwardly and retract inwardly, respectively;

wherein upon the alternate outward extension and inward retraction of each of the spring hinges, each of the claw members alternately extend and retract, respectively;

a cylindrical J-shaped first hook disposed on the handle front side proximal to the lower end of the handle;

a cylindrical J-shaped second hook disposed on the handle right side proximal to the lower end of the handle;

wherein each of the first hook and the second hook removably retain an item thereon.

12. The animal excrement collector device of claim 11 further comprising:

a hole disposed through the handle upper end;

a torus member;

wherein the torus member slidingly engages the hole;

wherein the torus member is sized to removably receive a wrist therethrough.

13. The animal excrement collector device of claim 12 further comprising an ergonomic lower edge of the trigger grip member, the ergonomic lower edge comprising:

a plurality of rounded protuberances disposed on the lower edge of the trigger grip mechanism;

a depression disposed between each of the protuberances;

wherein each of the depressions is sized to removably receive a finger therein.

14. The animal excrement collector device of claim 12 wherein the object is an amount of animal excrement.

15. The animal excrement collector device of claim 14 wherein the item is a waste collection bag in a holding position.

* * * * *